US010959893B2

(12) United States Patent
Mil et al.

(10) Patent No.: US 10,959,893 B2
(45) Date of Patent: Mar. 30, 2021

(54) TELESCOPIC SUPPORT COLUMN OF A MEDICAL DEVICE

(71) Applicant: Borcad Medical A.S., Frycovice (CZ)

(72) Inventors: Petr Mil, Baska (CZ); Bronislav Siuda, Trinec (CZ)

(73) Assignee: BORCAD MEDICAL A.S., Frycovice (CZ)

( * ) Notice: Subject to any disclaimer, the term of this patent is extended or adjusted under 35 U.S.C. 154(b) by 84 days.

(21) Appl. No.: 16/333,220

(22) PCT Filed: Sep. 13, 2017

(86) PCT No.: PCT/CZ2017/050042

§ 371 (c)(1),
(2) Date: Mar. 13, 2019

(87) PCT Pub. No.: WO2018/054401

PCT Pub. Date: Mar. 29, 2018

(65) Prior Publication Data

US 2019/0247252 A1 Aug. 15, 2019

(30) Foreign Application Priority Data

Sep. 20, 2016 (CZ) ..... CZ2016-582
Sep. 20, 2017 (WO) ..... PCT/CZ2017/050042

(51) Int. Cl.
*A61G 13/00* (2006.01)
*A61G 7/012* (2006.01)
(Continued)

(52) U.S. Cl.
CPC ..... *A61G 7/012* (2013.01); *A61G 13/06* (2013.01); *A61G 15/02* (2013.01)

(58) Field of Classification Search
CPC ..... A61G 7/00; A61G 13/00
(Continued)

(56) References Cited

U.S. PATENT DOCUMENTS 3,777,629 A * 12/1973 Johnston ..... F15B 21/08 91/524
4,195,829 A * 4/1980 Reser ..... A61G 13/02 5/607

(Continued)

FOREIGN PATENT DOCUMENTS

EP 1634558 A1 3/2006

OTHER PUBLICATIONS

WIPO, International Search Report, dated Dec. 18, 2017, in International Application No. PCT/CZ2017/050042, filed Sep. 13, 2017.

(Continued)

*Primary Examiner* — Fredrick C Conley
(74) *Attorney, Agent, or Firm* — Thedford I Hitaffer; Hitaffer & Hitaffer, PLLC

(57) ABSTRACT

The subject of this invention is a column (13) of a medical device such as a gynecological examination table or a birthing bed. The aim of the invention is to provide a method of vertical movement of the medical device quickly and with sufficient range. This is achieved by mounting a column drive by at least three successive linear drives and two connecting elements. The connecting elements enable connecting the successive linear drives off-level so that all the drives abut close to each other in the lowest position and a lower possible minimum position is achieved. The advantage of the telescopic column solution according to the present invention is also that it is able to achieve a higher maximum position by means of providing each two segments with their own linear drive. This also ensures much more efficient and faster vertical shift.

19 Claims, 6 Drawing Sheets

Figure 1:
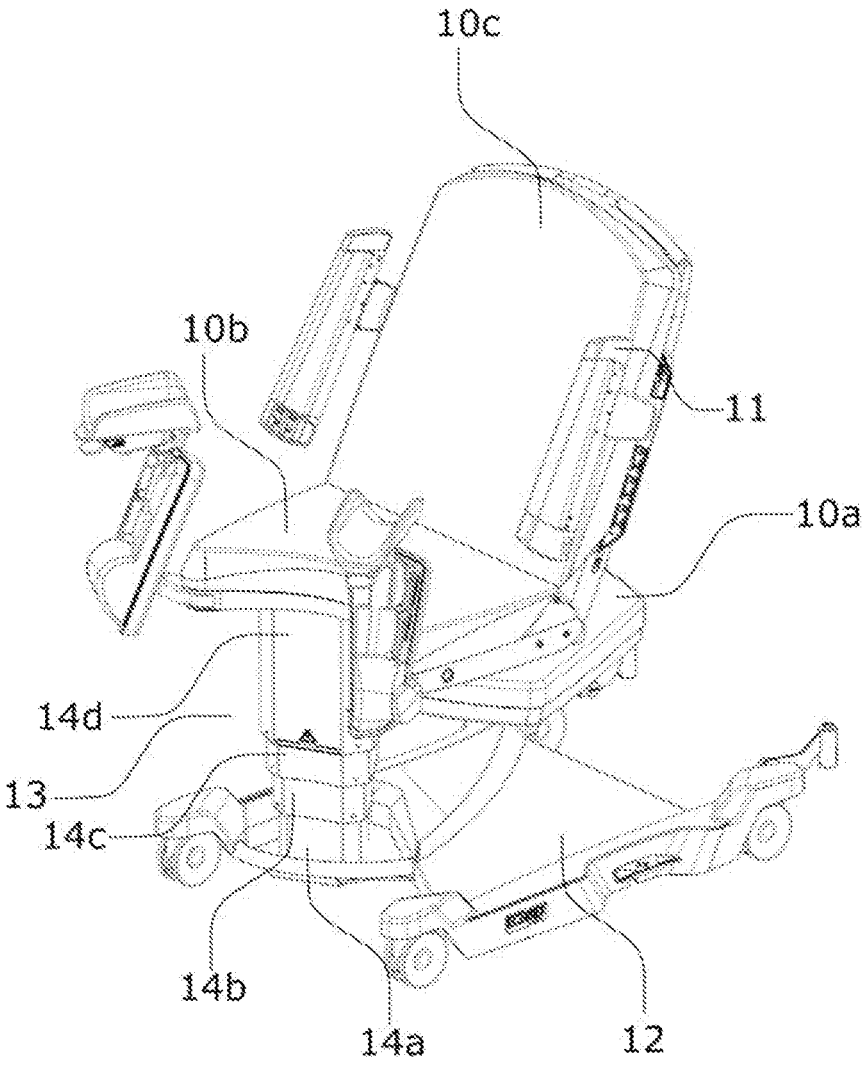

(51) Int. Cl.
*A61G 13/06* (2006.01)
*A61G 15/02* (2006.01)

(58) Field of Classification Search
USPC ..... 5/611, 600
See application file for complete search history.

(56) References Cited

U.S. PATENT DOCUMENTS

2007/0256555 A1 11/2007 Koop
2013/0205501 A1* 8/2013 Robertson ..... A61G 7/018
5/611

OTHER PUBLICATIONS

WIPO, Written Opinion, dated Dec. 18, 2017, in International Application No. PCT/CZ2017/050042, filed Sep. 13, 2017.

* cited by examiner

TELESCOPIC SUPPORT COLUMN OF A MEDICAL DEVICE

This application, filed under 35 USC 371, is a United States National Stage Application of International Application No. PCT/CZ2017/050042, filed Sep. 13, 2017, which claims priority to CZ Application No. PV 2016-582, filed on Sep. 20, 2016, the disclosures of which are incorporated herein by reference.

TECHNICAL FIELD

This technical solution relates to medical devices such as beds and chairs used in obstetrics, surgery, oncology, gynecology, dialysis, and further for example hospital beds, transport beds or operating tables utilizing a telescopic support column which enables height adjustment of the device.

PRIOR ART

The current trend in health care beds lies in increasing the height accessibility and manipulation with the rest area. The goal of constructors and designers is to simplify the use of beds for both patients and medical staff. Thus, when reducing the manipulation time, the emphasis is also placed on maintaining easy bed maintenance. Easy positioning allows medical staff to respond faster to patient needs.

Height positioning of health care beds and chairs is currently provided by several mechanisms. The first option is a telescopic positioning by means of manually operated mechanical rastomats or scissor lifts located below the rest area. The bed can be adjusted into several height levels. Positioning is challenging and in the presence of a patient also very difficult, and the height range is not sufficient. Another type of mechanical drive are simple mechanical linear drives converting rotational motion to linear one. Typically, the screw and nut mechanisms, wheel with axis mechanisms, or cams are used. These systems are very simple; however, they have many disadvantages. Positioning speed is limited by the rotation mechanism which requires physical labor.

Another option are electronically adjustable beds with various drive options. The most common are electric, pneumatic and hydraulic drives. The differentiating criteria for the individual drives are shift speed and accuracy, maximum/minimum adjustable bed height, positioning unit size, unit service and maintenance as well as safety and hygienic requirements.

The hydraulic drives require a mechanism consisting, among other things, of a tank, a pump and a valve, which makes this drive a more complex system than other types of drive. A pressurized fluid, usually a hydraulic oil, is used as a medium performing the shift.

The pneumatic drive is a linear drive utilizing compressed air. It achieves very precise positioning even in extreme positions. The entire mechanism is simple to maintain and less expensive to purchase than the hydraulic drive. The compressed air, however, is less effective, more expensive and louder in comparison with other media due to pressure losses.

The electric drive with an electric motor ensures the highest accuracy of position adjustment. During the movement, it is possible to control speed, strength and shift position. The electric motor performs a rotary motion and it is therefore necessary to convert this movement to linear movement. Screws, shafts, belts, or chains are utilized for this task.

Adjustment mechanisms are in health care beds located in telescopic columns consisting of at least two segments. The segments have always the same shape of their floor plan but different size so they can fit into each other in the minimum position. The drive unit performs the raising or lowering of the bed by shifting the individual segments in successive order or simultaneously. The adjustment mechanism of the standard health care bed consists of two or more telescopic columns containing one electric drive for lifting thereof. Modern specific health care beds, such as beds used in gynecology, obstetrics or oncology, are provided with only one telescopic column. Such bed has more utilizable manipulation space between chassis and rest area and its maintenance and operation is also simplified. In the column design, the emphasis is placed on stability of the entire bed and variability in height positioning and tilting of the rest area.

Patent document EP2197406 discloses a mechanism of column lifting by means of a drive and a chain tensioned on toothed gear. Depending on the direction of drive rotation, the bed is lifted or lowered. This method is technologically more complex due to the single motor drive unit and the height manipulation is limited.

Patent document EP1274330 discloses a mechanism of column lifting by means of an electric motor and a rotary spindle with two opposite threads from the inner and outer side. When the spindle is moved, the threaded circular segments begin to move in a different direction, and the bed is lifted or lowered. The lifting or lowering of the bed depends on the direction of the spindle rotation. The mechanism is controlled by one electric motor. This results in a time-consuming lifting of the bed because of the complexity of the mechanism. Friction losses occur in the mechanism and the threads are highly worn.

Patent document EP2594157 discloses a mechanism of column lifting with one electric motor and 2 helical spindles. The spindles functions as a screw-nut mechanism in which the hollow spindle acts as the nut with a hole diameter corresponding to the diameter of the second full spindle which acts as the screw. Column lifting is caused by rotating the spindle by the electric motor and by screwing or unscrewing thereof from the second spindle. In this solution, the minimum bed height is limited by the height of the spindle and the maximum height by combination of the heights of both spindles. The device is complicated and expensive to produce and it suffers from losses caused by the friction and rapid wearing-out of spindle threads.

These prior art technical solutions utilize only one drive unit for the vertical shift. This results in a more time-consuming complete lifting of the rest area. Solutions with a single drive unit are also unable to achieve some of the required minimum and maximum bed positions.

It is therefore clear that no solution of a telescopic column with autonomous drives for three or more column segments which would allow a greater range of minimum and maximum bed height and allowing a rapid shift from the minimum position to the operative position are known in the state of the art. Moreover, the known systems are relatively complicated and expensive to produce.

SUMMARY OF THE INVENTION

The above-mentioned drawbacks are to some extent removed by the column according to the present invention.

The aim of the invention is to provide a method of vertical movement of medical devices quickly and with sufficient range. This is achieved by mounting a column drive with at least three successive linear drives and two connecting elements.

The lowest linear drive is connected by its bottom side to the chassis of the medical device and by its upper side it is connected to the lower connecting element. The middle linear drive is by its upper side connected to the upper connecting element and by its bottom side it is connected to the lower connecting element. The uppermost linear drive is connected by its upper side to the upper connecting element and by its upper side it is connected to the rest area. The use of connecting elements enables attachment of the bottom side of the middle linear drive below the level of the upper side of the lower linear drive, and the bottom side of the third linear drive can be attached below the level of the upper side of the middle linear drive. This advantageously results in a lower minimum position as the motors in this position abut close to each other.

The column is attached to the bottom side of the rest area at the side edge of the seating portion so that at least 70% of its floor plan is located behind the longitudinal axis of rest area in the direction of the marginal outline of the rest area. From the other side, the column is attached to the chassis. The column is also used as the sole support for the rest area, thus saving space facilitating bed manipulation and maintenance.

The connecting elements include metal plates to which metal or plastic covers of the column drive are attached, which are telescopic segments. These segments are connected by sliding elements which are located on the outer upper side of each segment, except the upper segment, and the inner bottom side of each segment, except the lower segment.

The linear drive according to the present invention is an electric linear drive, converting the rotary motion of the electric motor into a linear tensile or pressure movement by means of a gear and a threaded rod with a nut.

Control of the column drive is located on the lateral side of the rest area or optionally on the rail. Alternatively, the column drive is controlled by a remote manual controller by wire or wireless or by foot wire or wireless controller. Control of the column drive on the rail of the medical device is lockable, which prevents unwanted actuation of the drive and shift of the rest area.

LIST OF DRAWINGS

FIG. 1—A view of a medical device with a tilted back portion and a foot portion in an inactive position and with extended column.

Figure 2:
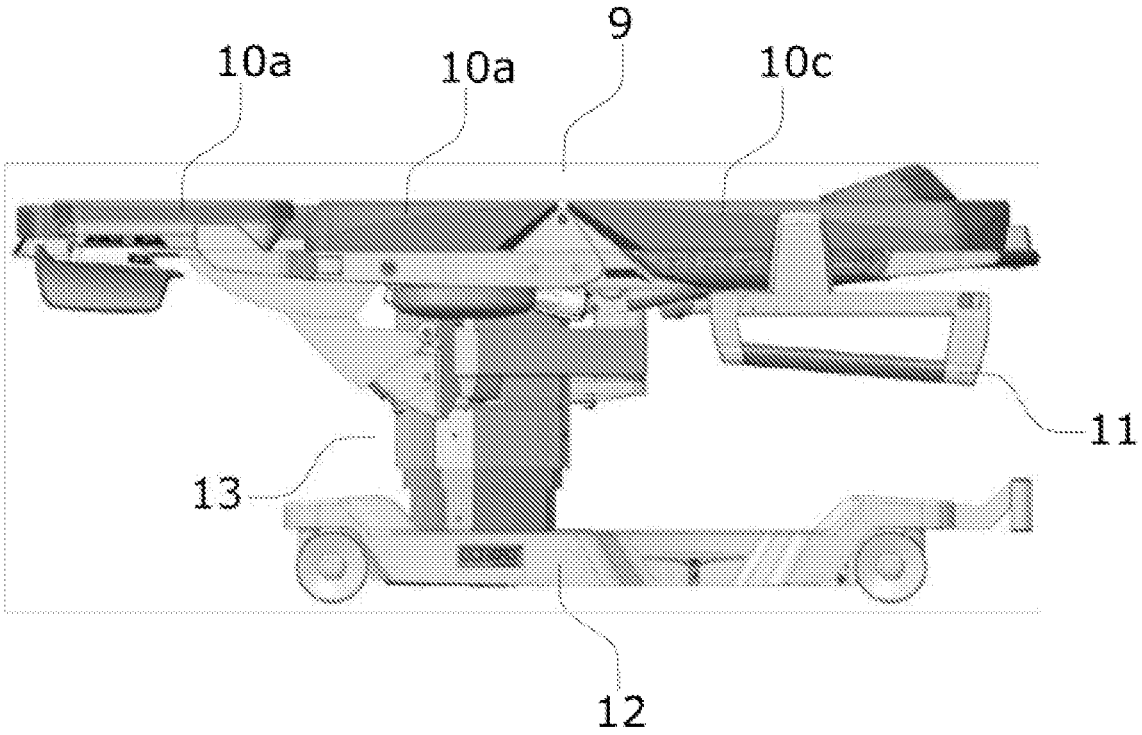

FIG. 2—A view of a medical device with a rest area with all parts in one plane. The column of the medical device is in the lowest position.

Figure 3:
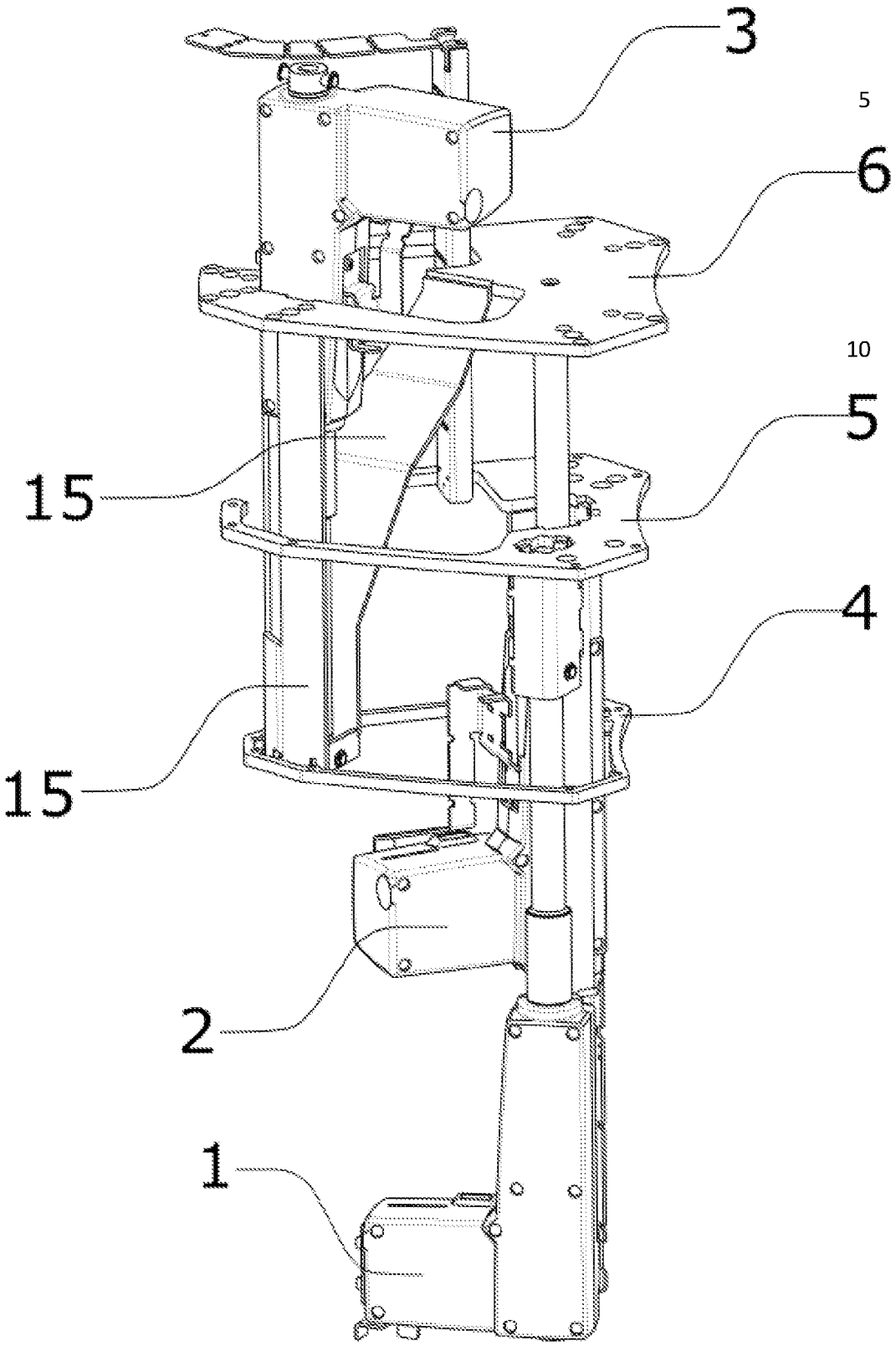

FIG. 3—A view of the column drive system design with linear drives and metal plates in the highest extended position.

Figure 4:
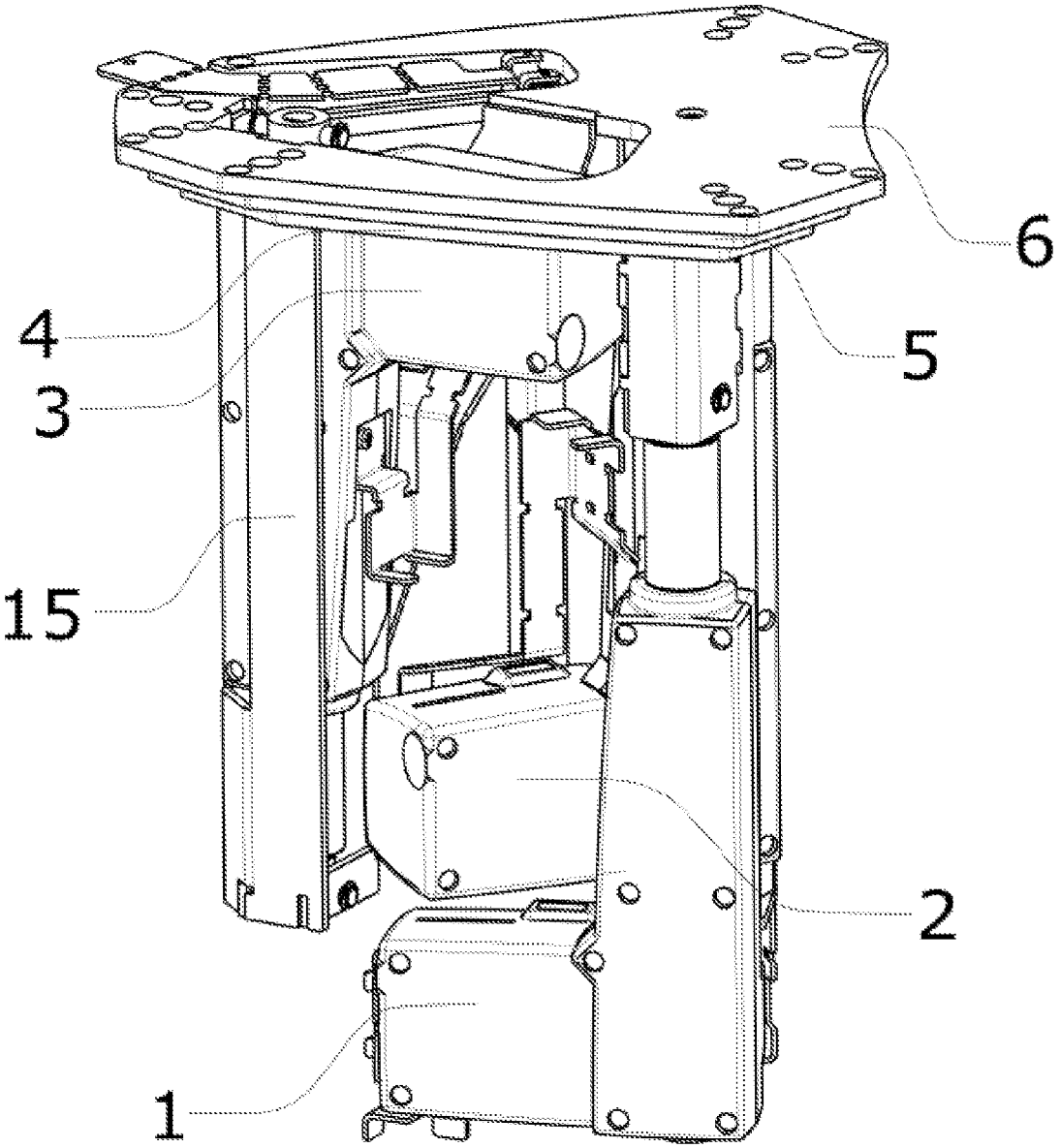

FIG. 4—A view of the column drive system design with linear drives and metal plates in the lowest retracted position.

Figure 5:
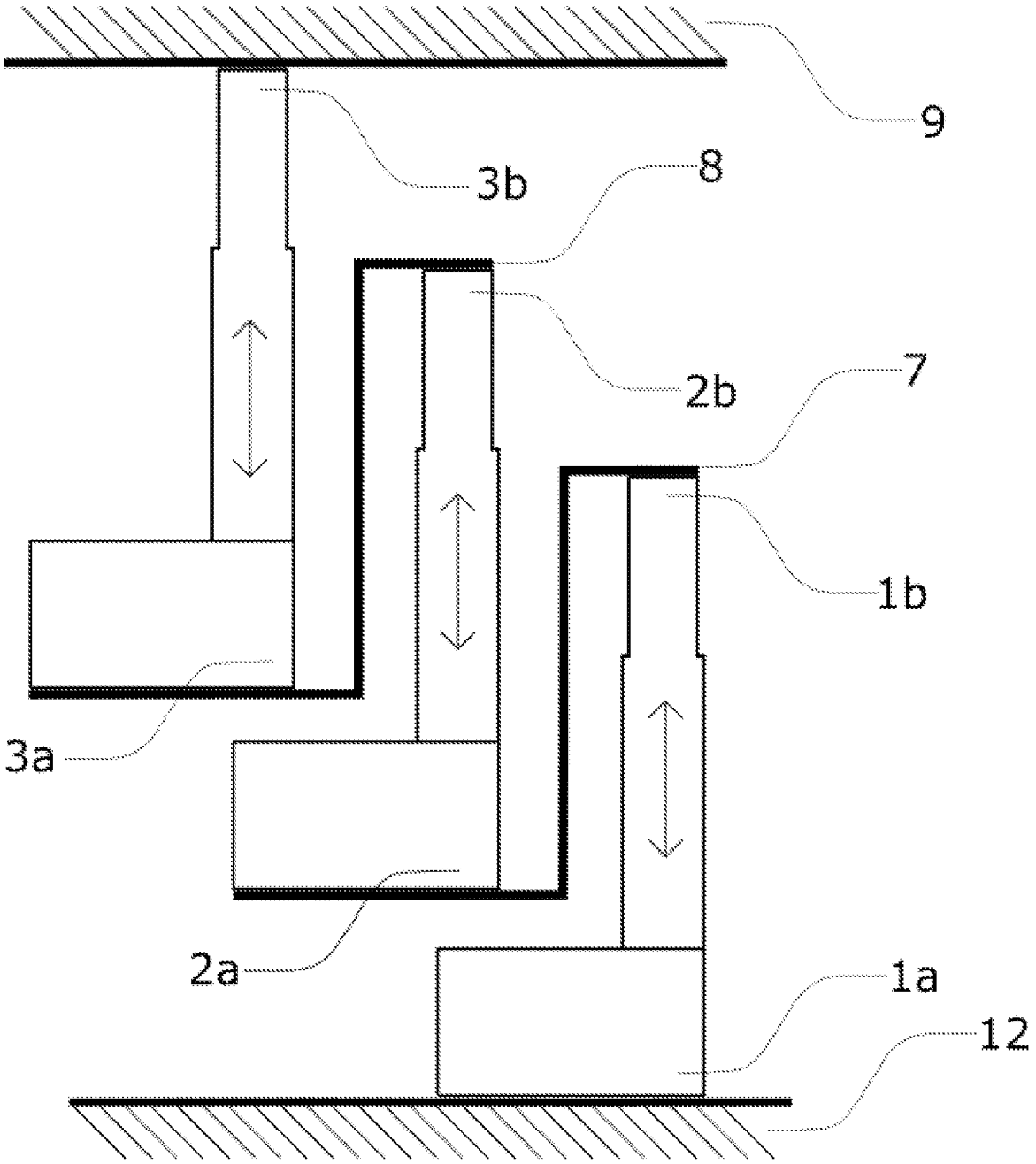

FIG. 5—Schematic illustration of the connection of linear drives in one of the possible versions.

Figure 6:
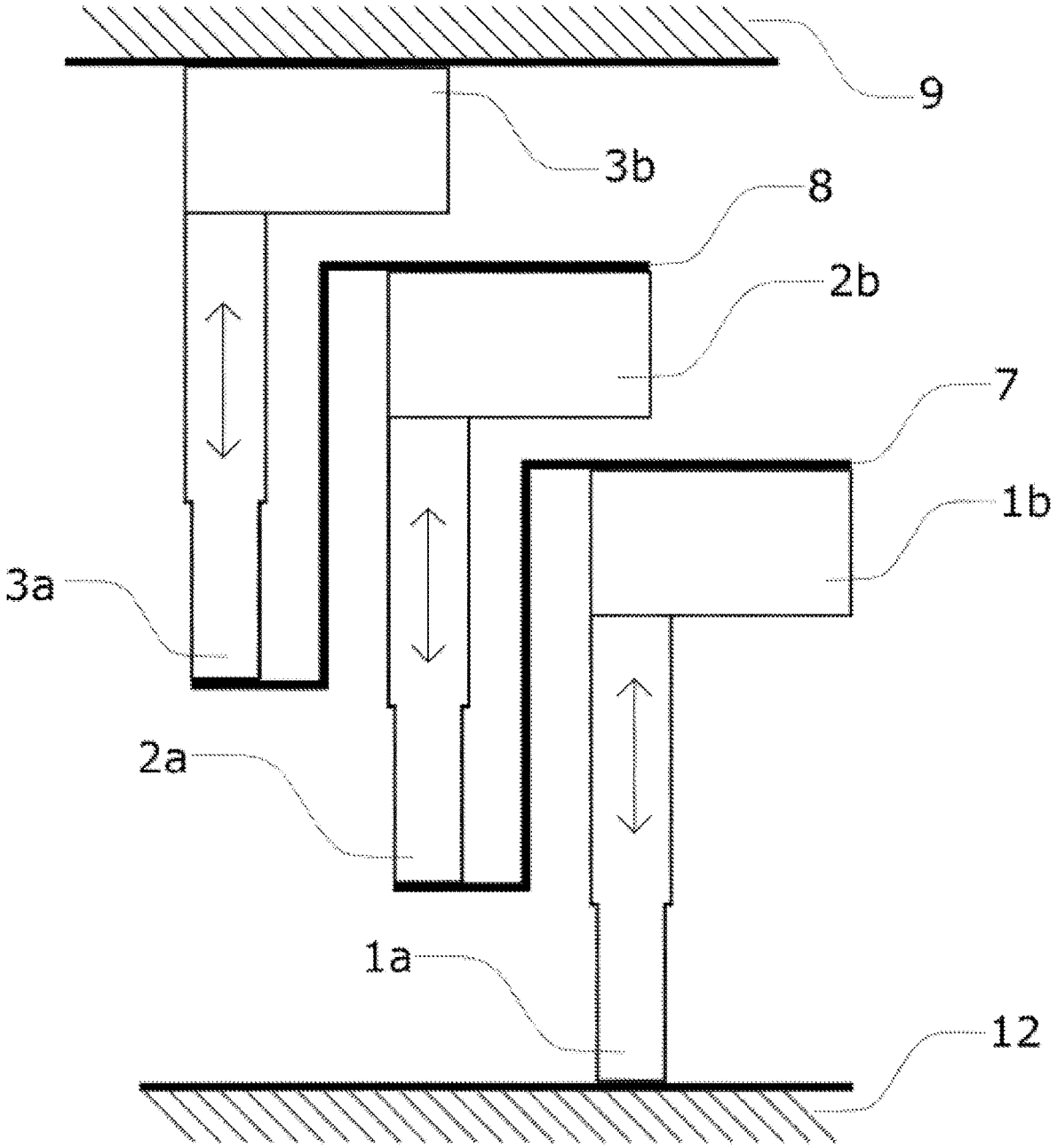

FIG. 6—Schematic illustration of the connection of linear drives in another possible version.

EXEMPLARY EMBODIMENTS OF THE INVENTION

Exemplary embodiment of the invention is a medical device, e.g. a gynecological examination bed or birthing bed such as in FIG. 1 or 2. The medical device contains an upper load-bearing area which is located e.g. on a column 13 located on a chassis 12. The column 13 may consist from one or more segments.

The upper load-bearing area contains a detachable rest area 9. The rest area 9 is adapted for easy maintenance. The rest area may be for example a layer of soft material for interaction with patient's body. The rest area may be formed for example by a foam layer from polyurethane foam, cold foam or a combination thereof. The foam layer is enclosed in a washable cover.

Chassis frame contains wheels. It contains at least three wheels, preferably four, a fifth center wheel can be added for better manipulation. The wheels can have a brake system which can be electrically, mechanically or hydraulically operated. Activation of the braking system may be performed by manual controller, foot controller or it can be automatic after period of time during which the medical device is not moving, or a combination thereof.

An infusion stand holder can be rotatably positioned on the chassis frame. The infusion stand holder can be rotatable between inactive and active position. In the active position, the infusion stand can be inserted into the infusion stand holder. In the inactive position, the infusion stand holder does not protrude outside the chassis frame, thereby eliminating the risk of tripping.

The upper load-bearing area may be composed of for example a back portion 10*c*, a seating portion 10*b* and a foot portion 10*a*. These portions may be formed, for example, by two or more castings and by upper and lower area. The upper and lower area may be, for example, a molded sheet metal. The castings may be interconnected for example by welding, screwing, rivet fastening or gluing to form a central portion. The central portion is connected to the upper or lower area for example by welding, screwing, rivet fastening or gluing. After connecting the upper and lower areas, a portion with enclosed area is created. Enclosure creates a space suitable for e.g. wiring and the surface of the portion is easier to maintain.

The column drive displayed in FIGS. 3 and 4 may consist of a plurality of concentric telescopic segments with each two adjacent segments provided with their own linear drives 1, 2, 3. There is one linear drive less than the number of segments in the column mechanism. The linear drive can be an electric linear drive with electric motor converting the rotary motion of the electric motor into a linear tensile or pressure movement by means of gear and threaded rod with nut.

Control of the column drive may be for the service staff located on the lateral side of the rest area of the back portion 10*c* and for the patient it can be located on the right or left side rail 11. Alternatively, the control may be located at any place easily accessible by hand or foot of the staff or the patient, as is known in the prior art. The control of the column drive by the patient can be locked so that he/she cannot move the bed.

In the construction of the medical device, the column drive is located below the seating portion 10*b*, for example at its edge or in the center. The most advantageous version of the column drive location is the location at the edge of the seating portion, thus as far as possible from the longitudinal axis of the rest area of bed or chair, in the direction of the lateral outline of the rest area. This opens the space below the rest area 9 in this embodiment for manipulation and storage of the foot portion 10*a*.

FIGS. 5 and 6 illustrate a schematic arrangement of the linear drives in the telescopic column 13. In the exemplary embodiment, the linear drives are three electric linear drives, a lower linear drive 1, a middle linear drive 2, and an upper linear drive 3 which are interconnected by connecting elements. The connecting elements are fixed parts which have points for the attachment of linear drives, and at least two of these points are spaced apart in the direction of the column axis. The lower linear drive 1 is connected to the chassis 12 by its bottom side 1. The upper side 1*b* of the lower linear drive is connected to the lower connecting element 7. The middle linear drive 2 is at its bottom side 2*a* connected to the lower connecting element so that the bottom side 2*a* of the middle linear drive 2 is connected to the lower connecting element 7 below the level of attachment of the upper side 1*b* of the lower linear drive 1 to the lower connecting element 7. The middle linear drive 2 is on its upper side 2*b* connected to the upper connecting element 8. The upper linear drive 3 is on its lower side 3*a* connected to the upper connecting element 8 so that the bottom side 3*a* of the upper linear drive 3 is connected to the upper connecting element 8 below the level of the attachment of the upper side 2*b* of the middle linear drive 2 to the upper connecting element 8. The upper linear drive 3 is on its upper side 3*b* connected to the rest area 9.

The column drive can consist of four or more telescopic segments. These segments are shaped to accommodate the individual linear drives.

In some embodiments, for achieving great maximum height, it is advisable to utilize for example four linear drives and a circular or square cross-section of the telescopic segments. Alternatively, for example, a rectangular or any optional n-angled shape of the telescopic segments, which forms the outer cover of the column drive, may be utilized.

In the exemplary embodiment, all the segments 14*a*, 14*b*, 14*c*, 14*d* are provided by sliding elements which ensure column guidance during vertical movement and which also serve as a column support.

The uppermost segment 14*d* is firmly connected to the rest area 9 and the lowest segment 14*a* is firmly connected to the chassis 12. The lowest segment includes a plate 4 with an inner hole sized approximately to the size of the inner hole of the narrowest segment, firmly connected to the lowest segment at the upper part of the lowest segment. The number of connecting elements is one less than the number of linear drives, and the connecting elements are attached at the upper part of each inner segment. The connecting elements are in this exemplary embodiment plates with the inner hole sized approximately to the size of inner opening of the narrowest segment and the load-bearing portion spaced apart from the metal plates for the location and attachment of the linear drives, wherein the load-bearing portions spaced apart from the metal plates are connected by means of the sheet metal elements 15. In the lowest retracted position, the connecting element plates and the lowest segment plate abut close to each other and all linear drives, including control cables and cables conducting current, are housed essentially in their entirety in the lowest segment without any limitations.

In the exemplary illustrative four-segment embodiment of three linear drives illustrated in FIGS. 1 to 4, the lower linear drive 1 is located in the lowest segment 14*a*, and this drive is connected to the second segment 14*b* on its upper side 1*b* attached to the lower connecting element 7 of the second segment 14*b*. The lower linear drive 1 is at its lower side 1*a* attached to the lower segment 14*a* or to the chassis 12. The middle linear drive 2 is attached to the lower connecting element 7 of the second segment 14*b* by its bottom side 2*a*, wherein the middle linear drive 2 is attached below the level of the upper side 1*b* of the lower drive 1 when the second linear drive 2 moves the third segment 14*c* by means of its upper side 2*b* attached to the upper connecting element 8 of the third segment 14*c*. The last upper linear drive 3 is located in the uppermost segment 14*d* of the column drive attached to the rest area 9 of the medical device by the upper side 3*b* of the upper linear drive 3, when this drive is connected to the third segment 14*c* of the telescopic column 13 on the bottom side 3*a* attached to the upper connecting element 8 of the third segment 14*c*. The upper linear drive 3 moves the rest area, wherein the upper side 3*b* of the upper linear drive 3 is attached to the rest area 9 or to the uppermost segment 14*d*. The lower side 3*a* of the upper linear drive 3 is attached to the upper connecting element 8 of the third segment 14*c* and its bottom side 3*a* is located below the level of the upper side 2*b* of the second linear drive 2, due to the possibility of retracting the last drive to the level of the plate 6 of the third segment 14*c*.

This connection allows to achieve very low height of the rest area 9 by the linear drives 1, 2, 3 in the lowest retracted position, wherein all metal plates 4, 6, 5 abut close to each other in the lowest retracted position shown in FIG. 4. This position is suitable for entering the bed, especially in the case of pregnant patients. The low minimum position is also advantageous for CPR (Cardiopulmonary resuscitation) and is further used as a safe position into which the rest area is set when the patient is left alone to minimize the consequences in case of falling from the rest area to the ground. The highest position is ergonomically advantageous for medical staff and is often referred to as an examination position.

LIST OF REFERENCE SIGNS

1—Lower linear drive
1*a*—Bottom side of lower linear drive
1*b*—Upper side of lower linear drive
2—Middle linear drive
2*a*—Bottom side of middle linear drive
2*b*—Upper side of middle linear drive
3—Upper linear drive
3*a*—Bottom side of upper linear drive
3*b*—Upper side of upper linear drive
4—Lowest segment plate
5—Second segment plate
6—Third segment plate
7—Lower connecting element
8—Upper connection element
9—Rest area of medical device
10*a*—Foot portion
10*b*—Seating portion
10*c*—Back portion
11—Rail
12—Chassis
13—Telescopic column
14*a*-Lowest segment of telescopic column
14*b*-Second segment of telescopic column
14*c*-Third segment of telescopic column
14*d*—Uppermost segment of telescopic column
15—Sheet metal element

The invention claimed is:

1. A medical device comprising:

a rest area comprising a seating portion and a back portion, a chassis, a telescopic support column, wherein the telescopic support column comprises at least three successive linear drives comprising a lower linear drive, a middle linear drive and an upper linear drive, and at least two connecting elements comprising a lower connecting element and an upper connecting element, wherein the lower linear drive has a lower side connected to the chassis of the medical device and an upper side connected to the lower connecting element, wherein the middle linear drive has an upper side connected to the upper connecting element and a lower side connected to the lower connecting element, wherein the upper linear drive has a lower side connected to the upper connecting element and an upper side connected to the rest area, and wherein the connection elements comprise plates and the linear drives are connected in relation to the plates so that the plates abut substantially close to each other when the linear drives are in a retracted position.

2. The medical device according to claim 1, wherein the middle linear drive has a bottom side attached below the level of the upper side of the lower linear drive and that the upper linear drive has a bottom side attached below the level of the upper side of the middle linear drive.

3. The medical device according to claim 1, wherein the column further comprises at least two segments comprising a first segment and a second segment, and wherein the connecting elements further comprise an attachment point for the linear drives spaced apart from the plates, wherein the plates comprises at least a first plate associated with the first segment and a second plate associated with the second segment, and wherein the first plate is connected to the upper side of the lower linear drive and the attachment point spaced apart from the first plate is connected with the lower side of the middle linear drive, and wherein the second plate is connected to the upper side of the middle linear drive and the attachment point spaced apart from the second plate is connected to the lower side of the upper linear drive.

4. The medical device according to claim 1, wherein the column is attached to the lower side of the rest area at a side edge of a seating portion of the rest area so as to be laterally offset in relation to the rest area, and wherein the column has another side that is attached to the chassis.

5. The medical device according to claim 1, wherein the column comprises covers comprising telescopic segments that are attached to the plates of the column and to the rest area, and the covers are connected by sliding elements, which are located on an upper side of each segment, except an upper segment, and on an inner bottom side of each segment, except a lower segment.

6. The medical device according to claim 5, wherein the linear drives move adjacent ones of the segments independently of the other linear drives.

7. The medical device according to claim 1, wherein the linear drives are electric linear drives converting rotary motion of an electric motor into linear tensile or pressure movement by means of a gear and a threaded rod with a nut.

8. The medical device according to claim 1, wherein a control of the column is located on the lateral side of the rest area or on a rail, or the column is controlled by a remote manual controller by wire or wirelessly; or the column is controlled by a foot wire or wireless controller.

9. The medical device according to claim 8, wherein the control of the column on the rail of the medical device is lockable.

10. A medical device comprising:

a rest area comprising a seating portion and a back portion, a chassis, and a telescopic support column, wherein the telescopic support column comprises at least three successive linear drives comprising a lower linear drive, a middle linear drive and an upper linear drive, and at least two connecting elements comprising a lower connecting element and an upper connecting element, wherein the lower linear drive has a lower side connected to the chassis of the medical device and an upper side connected to the lower connecting element, wherein the middle linear drive has an upper side connected to the upper connecting element and a lower side connected to the lower connecting element, and wherein the upper linear drive has a lower side connected to the upper connecting element and an upper side connected to the rest area, wherein at least one of the linear drives extends in a first direction and at least one of the other linear drives extends in a second direction, opposite to the first direction.

11. The medical device according to claim 10, wherein the middle linear drive has a bottom side attached below the level of the upper side of the lower linear drive and that the upper linear drive has a bottom side attached below the level of the upper side of the middle linear drive.

12. The medical device according to claim 10, wherein the column further comprises at least two segments comprising a first segment and a second segment, and wherein the connecting elements further comprise plates and attachment points for the linear drives spaced apart from the plates, wherein the plates comprises at least a first plate associated with the first segment and a second plate associated with the second segment, and wherein the first plate is connected to the upper side of the lower linear drive and the attachment point spaced apart from the first plate is connected with the lower side of the middle linear drive, and wherein the second plate is connected to the upper side of the middle linear drive and the attachment point spaced apart from the second plate is connected to the lower side of the upper linear drive.

13. The medical device according to claim 10, wherein the column is attached to the lower side of the rest area at a side edge of a seating portion of the rest area so as to be laterally offset in relation to the rest area, and wherein the column has another side that is attached to the chassis.

14. The medical device according to claim 10, wherein the column comprises covers comprising telescopic segments that are attached to plates of the column and to the rest area, and the covers are connected by sliding elements, which are located on an outer upper side of each segment, except an upper segment, and on an inner bottom side of each segment, except a lower segment.

15. The medical device according to claim 14, wherein the linear drives move adjacent ones of the segments independently of the other linear drives.

16. The medical device according to claim 10, wherein a control of the column is located on the lateral side of the rest area or on a rail, or the column is controlled by a remote manual controller by wire or wirelessly; or the column is controlled by a foot wire or wireless controller.

17. The medical device according to claim 16, wherein the control of the column on the rail of the medical device is lockable.

18. The medical device according to claim 10, wherein the linear drives are electric linear drives converting rotary motion of an electric motor into linear tensile or pressure movement by means of a gear and a threaded rod with a nut.

19. A medical device comprising:

a rest area comprising a seating portion and a back portion, a chassis, and a telescopic support column, wherein the telescopic support column comprises at least three successive linear drives comprising a lower linear drive, a middle linear drive and an upper linear drive, and at least two connecting elements comprising a lower connecting element and an upper connecting element, wherein the lower linear drive has a lower side connected to the chassis of the medical device and an upper side connected to the lower connecting element, wherein the middle linear drive has an upper side connected to the upper connecting element and a lower side connected to the lower connecting element, and wherein the upper linear drive has a lower side connected to the upper connecting element and an upper side connected to the rest area, and wherein the connection elements comprise plates and attachment points for the linear drives spaced apart from the plates, and wherein the column further comprises at least two segments comprising a first segment and a second segment, wherein the plates comprise a first plate associated with the first segment and a second plate associated with the second segment, wherein the first plate is connected to the upper side of the lower linear drive, which passes through an inner hole in the first plate, and one of the attachment points spaced apart from the first plate is connected with the lower side of the middle linear drive, and wherein the second plate is connected to the upper side of the middle linear drive, which passes through an inner hole in the second plate, and one of the attachment points spaced apart from the second plate is connected with the lower side of the upper linear drive.

* * * * *